United States Patent [19]

Amdahl et al.

[11] Patent Number: 4,806,031

[45] Date of Patent: Feb. 21, 1989

[54] UNIFORM PRINT DENSITY AND REGISTRATION IN AN IMPACT PRINTER

[75] Inventors: Paul O. Amdahl, Granada Hills; John K. Ham, Simi Valley; Doina Mazilu, Woodland Hills, all of Calif.

[73] Assignee: DataProducts Corporation, Woodland Hills, Calif.

[21] Appl. No.: 897,734

[22] Filed: Aug. 15, 1986

[51] Int. Cl.[4] ..... B41J 9/14; B41J 3/10

[52] U.S. Cl. ..... 400/157.3; 400/124; 400/166; 101/93.03; 101/93.04; 101/93.29; 361/154

[58] Field of Search ..... 101/93.03, 93.29, 93.48, 101/93.04; 400/53, 124, 157.3, 174, 175, 55, 166, 125; 361/154

[56] References Cited

U.S. PATENT DOCUMENTS

| | | | |
|---|---|---|---|
| 3,712,212 | 1/1973 | Beery | 101/93.03 |
| 4,162,131 | 7/1979 | Carson, Jr. et al. | 101/93.03 X |
| 4,259,903 | 4/1981 | Orendt et al. | 101/93.03 |
| 4,262,592 | 4/1981 | Araki | 101/93.03 |
| 4,347,786 | 9/1982 | Tweat, Jr. et al. | 101/93.03 |
| 4,440,079 | 4/1984 | Dayger et al. | 400/157.3 X |
| 4,476,781 | 10/1984 | Kubachi et al. | 400/157.3 X |
| 4,493,253 | 1/1985 | Vyas | 400/166 X |
| 4,547,087 | 10/1985 | Heider et al. | 400/157.3 X |
| 4,678,355 | 7/1987 | Gaba et al. | 400/166 X |

FOREIGN PATENT DOCUMENTS

| | | | |
|---|---|---|---|
| 74672 | 6/1980 | Japan | 101/93.03 |
| 1309050 | 3/1973 | United Kingdom | 101/93.03 |

OTHER PUBLICATIONS

Zerox Disc journal, "Variable Hammer Delay", Deety, vol. 4, No. 2, Mar./Apr. 1979, pp. 157 and 158.

*Primary Examiner*—David A. Wiecking
*Assistant Examiner*—James R. McDaniel
*Attorney, Agent, or Firm*—Spensley Horn Jubas & Lubitz

[57] ABSTRACT

Commencing with the first print hammer(s) "out", or actuated, on each print line the hammer drive current is boosted 10% for a period, ranging from 25%=650 microseconds for single part forms to 50% for multipart forms, of the total print hammer flight time. Earlier striking hammers on each print line strike harder, alleviating displaced first-printed characters on single part forms and light characters on multipart forms due to hammer energy loss in forms compression.

8 Claims, 6 Drawing Sheets

Fig. 1c1 (OLD)

(LINE 1) H H H
(LINE 2) H
(LINE 3) H H H

Fig. 1c2 (OLD)

(LINE 1) A A A
(LINE 2) A A A
(LINE 3) A A A

Fig. 1d1 (NEW)

(LINE 1) H H H
(LINE 2) H
(LINE 3) H H H

Fig. 1d2 (NEW)

(LINE 1) A A A
(LINE 2) A A A
(LINE 3) A A A

| | | 1300 μsec. / 2.6 msec = 50% |
|---|---|---|
| #1 AFFECTED WITH BOOST | | |
| #2 AFFECTED WITH BOOST | (1300 − 173 = 1127 μsec.) / 2.6 msec = 43% | |
| (EMPTY) WOULD HAVE BEEN AFFECTED WITH BOOST | (1300 − 2(.173) = 954 μsec.) / 2.6 msec = 37% | |
| #3 AFFECTED WITH BOOST | (1300 − 3(.173) = 781 μsec.) / 2.6 msec = 30% | |
| #4 AFFECTED WITH BOOST | (1300 − 4(.173) = 608 μsec.) / 2.6 msec = 23% | |
| (EMPTY) WOULD HAVE BEEN AFFECTED WITH BOOST | (1200 − 5(.173) = 435 μsec.) / 2.6 msec = 17% | |
| #5 AFFECTED WITH BOOST | (1300 − 6(.173) = 262 μsec.) / 2.6 msec = 10% | |
| #6 AFFECTED WITH BOOST | (1300 − 7(.173) = 89 μsec.) / 2.6 msec = 3% | |
| #7 AFFECTED WITH BOOST | (1300 − 8(.173) = 0 μsec.) / 2.6 msec = NOT AFFECTED (0%) | |

Fig. 5d

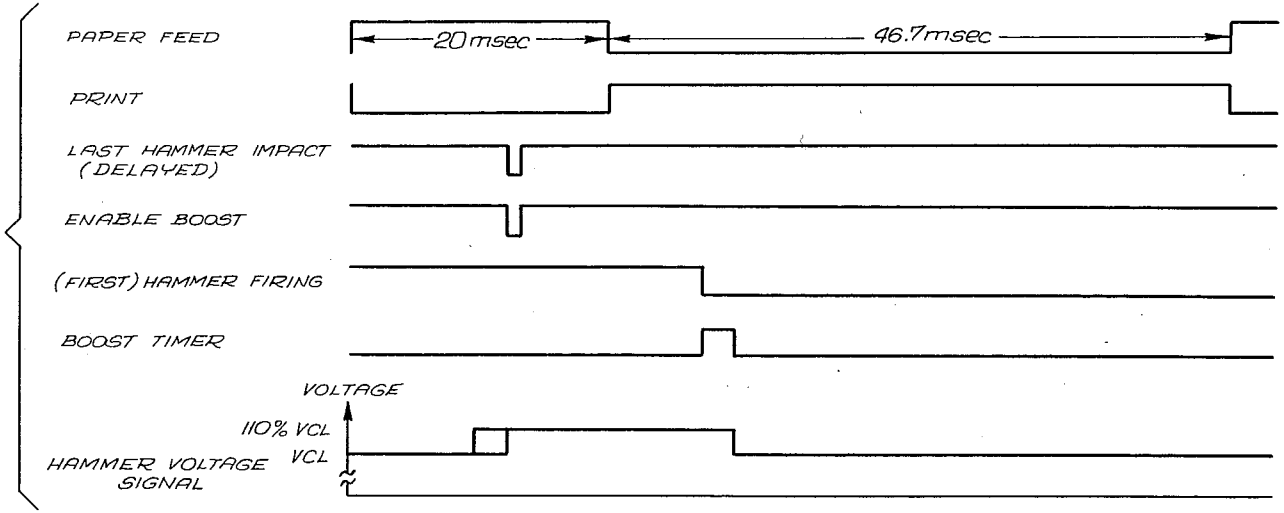

Fig. 6

UNIFORM PRINT DENSITY AND REGISTRATION IN AN IMPACT PRINTER

BACKGROUND OF THE INVENTION

1. Field of the Invention

The present invention generally concerns alleviating displaced first-printed characters on single-part forms, and light characters on multi-part forms, due to the energy loss incurred in forms compression by that print hammer(s) first printing upon each line in an impact printer. The invention specifically concerns boosting the hammer drive current for the first print hammer(s) actuated in the printing of each line by an impact printer.

2. Description of the Prior Art

There exists a problem with the print quality of an impact printer, most particularly a band printer but also any printer such as a drum printer, wherein a hammer strikes a form to press such form against a type font disposed proximate to such form and oppositely to the hammer, thereby printing the character of such type font. This problem with an impact printer, particularly visible on multipart forms, resides in the fact that the first hammer(s) fired upon each print line must compress the forms paper, and thus dissipate energy which would otherwise be used in the generation of the printed character. The result of this energy loss is a light character on multi-part forms, or a displaced character on single-part forms. The displaced character problem is most noticeably visible for characters having a strong vertical line component, such as a "H" or "F", when such characters repetitively appear in the same print position, or column, of many lines upon a printed form. When certain ones of the characters, in certain lines, are printed by first, or early, hammers fired in the printing of such lines whereas others of the characters, in other lines, are printed by later-fired hammers then the problem is manifested. The problem is noticeable as a "ragged", non-aligned, appearance of the characters in the print columns. The problem is so widely prevalent and recognized that it has an ascribed name: "the first hammer out problem", meaning that the problem is resultant from a condition occurring with the first actuated print hammers upon each print line.

The traditional, prior art, method of attempting to deal with that first hammer out problem which results in displaced and/or light characters in the print line printed by an impact printer is to attempt to better mechanically compress the form. Mechanical forms compressors have been used, which can either be passive-type compression fingers or active-type devices such as electronically controlled clamps which are enabled only during printing. The disadvantages of these mechanical forms compression methods are many. For the simpler and more rudimentary methods where the form is continually compressed, as by passive-type compression fingers, such compression may be in conflict with the reliable and rapid movement of the form through the printer in the printing of successive lines. The active-type compression devices, which may only attempt to compress the form simultaneous with the printing of each line and release compression during forms movement, are expensive and unreliable. Further, both methods must operate at some distance from the actual strike point of the print hammer upon the form, and are thus necessarily imperfect in securing the optimal forms registration and compression at that very point(s) which counts most, the point(s) opposite the first striking print hammer(s) wherein the first character(s) will be printed upon each print line. Finally, it should be recognized that any mechanical forms compression system separate from the remaining operative parts, and core functionality, of the printer will have negative cost and reliability implications to the implementation of the basic printer function which is simply to print.

SUMMARY OF THE INVENTION

The present invention is concerned with obtaining improved uniform print density and print registration in an impact printer, particularly a band printer but also other types of impact printers such as drum printers wherein print hammers do strike a form to force such against a character font thereby printing a character upon a print line. Specifically, the present invention deals with alleviation of the "first hammer out" problem wherein energy loss due to paper compression by the first print hammer(s) actuated during the printing of each print line results in, for characters printed by such first-fired print hammer(s), a displaced character(s) particularly on a single-part form and/or a light character(s) particularly on a multi-part form.

The preferred embodiment of the present invention uses components already existing in the printer in order to better compress the form at the very point(s) wherein the first character(s) are first printed upon each print line. Mainly, the preferred embodiment of the invention uses the first-fired, or actuated, print hammer(s) itself (themselves), providing it (them) with higher energy in order to compensate for the energy loss incurred in paper compression. The drive current is increased for the first hammer(s), resulting in increased energy and, thus, impact force.

Specifically, in an apparatus and method implemented in accordance with the present invention a boost of the current drive of all the one or more print hammers first fired is enabled. This current boost, nominally a 10% higher hammer drive current, is enabled for a period of time commencing with the flight of the first print hammer(s) to print upon each print line. The current boost is enabled regardless of howsoever far it may be into the print cycle time before a first character(s) is to be printed. The duration of the time period of current boost will be variably predetermined by the magnitude of the current which is being boosted, which magnitude is itself predeterminedly fixed by an operator setting of the print hammer strike energy in consideration of the number of parts within the form being printed.

For the lowest current setting used with single part forms, the 10% higher current boost for the first print hammer(s) is enabled for 25% of the print hammer flight time. For the highest current setting used with thick multi-part forms, the same 10% current boost is enabled for the first print hammer(s) for a duration equal to 50% of the print hammer flight time. For a 900-line-per-minute printer, the print hammer flight time is typically 2.6 milliseconds, making that a 10% current boost for a minimum, 25%, portion of such flight time will last for 650 microseconds. Since in the same 900-line-per-minute printer a successive one(s) print hammer(s) of a nominal one hundred and thirty-six total print hammers may be successively fired upon each 173 microsecond subinterval of a 692 microsecond minor print interval, it is possible for the print hammer or hammers which are fired at up to four successive such subintervals (commencing with the subinterval of the first overall hammer's (hammers') firing) to be affected with a current boost. Such current boost will be applied for a progressively smaller duration to print hammer(s) firing in each subinterval after the first subinterval upon which any such print hammer(s) does (do) fire. It should be understood that all print hammers, one or more, fired within each and any of the four subintervals of the effected first minor print time interval are boosted.

The summary effect is that the print hammer or hammers "out" or energized, upon the first time subinterval at which any print hammer is energized will receive a maximum current boost. If another print hammer or hammers fires upon a time subinterval suitably proximate to this first time subinterval, such following print hammer or hammers will also receive current boost in proportion to the proximity in time at which they do follow the first print hammer(s) out. If no print hammer(s) follow sufficiently proximate in time, only the very first print hammer(s) will receive the current boost. After expiration of the minor print interval of four subintervals, no print hammer will be boosted until the printing of another line Expressed in numbers, from a single 1 print hammer up to a nominal 34 (one-quarter of the 136 total print hammers) print hammers will fire on some first interval. For the first interval, howsoever early or late in the overall print cycle, whereupon any print hammer fires, then all print hammers fired within that first interval are boosted in current drive. The duration of this boost of first interval print hammers is nominally, for one operator adjustment, 25% of that print hammer flight time from rest to impact, which is nominally 650 microseconds. At a next, second, interval some 173 microseconds later, from 0 to 34 print hammers may fire. All firings are boosted for 650 microseconds minus 173 microseconds, or 477 microseconds. If no print hammers fire, none are boosted. Similarly upon each of the next, third and fourth, following intervals from 0 to 34 print hammers may fire. Third interval print hammer firings (if any) are boosted for 304 microseconds, and fourth interval print hammer firings (if any) are boosted for 131 microseconds. Subsequent to this fourth interval no boost will transpire until first printing on a next subsequent print line.

Correspondingly it is a first object of the present invention that the current drive of print hammers striking a workpiece form in an impact printer should be controllable, and that such drive will be controlled to apply more current to that (those) print hammer(s) first striking a workpiece from in each line printed by such impact printer.

It is a second object of the present invention that such current boost supplied to that (those) print hammer(s) first actuated in each line printed by an impact printer will be proportional to the level of drive current normally supplied to such print hammers, which normal drive current level is variably predetermined by an operator to be higher for multipart paper forms and to be lower for single-part paper forms. Further, it will be the duration of the current boost which is made proportional to the normal drive current level.

It is a third object of the present invention that the application of a boost to the current drive of that (those) print hammer(s) first striking on each line printed by an impact printer will be at a predetermined level of the normal hammer drive current, nominally 10%, and will last for a predetermined fractional portion of the print hammer flight time, nominally within the range of 25% to 50% of the normal print hammer flight time.

It is a fourth object of the present invention that the boost applied will be sufficient to compensate for the loss of print energy which results from the compressing of a paper form by the first print hammer(s) striking such paper form upon each printed line, and that, further, a boost of diminishing magnitude will be applied to successive print hammer(s) fired at successive times which are sufficiently proximate to the time of the initial firing. By such a manner of intensity controlled and time distributed boost to the current drive of the first print hammer(s) and its (their) immediate successor(s), all characters upon a line printed by an impact printer will exhibit equal spatial registration and uniform print density. This will be true regardless of the time or times, early or late within the print cycle, at which such characters are printed upon each print line.

It is a fifth object of the present invention that the apparatus and method for alleviating the firsthammer out problem will be implemented at low cost and high reliability with those components—the print hammers and the current drivers thereof—which are already present within an impact printer. The preferred embodiment circuit in accordance with the present invention is a modification to that existing current amplifier within an impact printer which provides current drive to the print hammers.

It is a sixth object of the present invention that it should be universally adaptable to impact printers of disparate types. The present invention may be tailored to provide appropriate boost energy to impact printers of disparate band, drum, and other types; to printers with different font velocity and/or font size; to printers with print hammers exhibiting varying flight time and/or current requirements; to printers employing print intervals and print interval timing of various durations; and to printers printing forms of various materials and structure of all nature, specifically including forms varying in compressibility and resistence to compression. When the present invention is installed and simply adjusted, which adjustment may be empirically accomplished, within an impact printer then it will significantly alleviate problems with the uniform density and uniform registration of printed characters.

These and other objectives are met by the preferred embodiment of the present invention, as hereinafter described.

BRIEF DESCRIPTION OF THE DRAWINGS

FIG. 1*c* and FIG. 1*d* respectively show pictorial representations of the problems of print character registration, and print character density, dealt with by the present invention.

FIG. 5*d* shows an analysis of the times over which print hammer current is maximally boosted in accordance with the example print hammer firings shown in FIG. 5*b*.

FIG. 6 shows a timing diagram of certain signals of pertinence to the operation of the present invention.

DESCRIPTION OF THE PREFERRED EMBODIMENT

The present invention is concerned with providing additional energy to a print hammer or hammers first energized in the printing of a first character or characters within each print line printed by an impact printer. This additional energy is provided in order to compensate for the energy loss which this (these) first actuated print hammer(s) particularly incurs in compressing the paper struck by such print hammer(s). Since the paper form being printed on is significantly compressed by the first print hammer(s) striking such, print hammers striking such paper at a later time during each print cycle do not suffer this energy loss. Forbearing that additional energy should be applied in order to overcome the energy loss which is incurred in compressing the paper, the character(s) printed by the print hammer(s) first striking upon each printed line (whatsoever this (these) character(s) may be) are prone to be positionally displaced and/or of substandard print density. The present invention provides additional energy to the print hammer(s) first striking upon each printed line by boosting the drive current of such hammer(s). Employment of the boost current of the present invention to a first firing print hammer(s) in an impact printer improves the positional registration and the density uniformity of the characters upon a line printed by such printer.

Figure 1A:
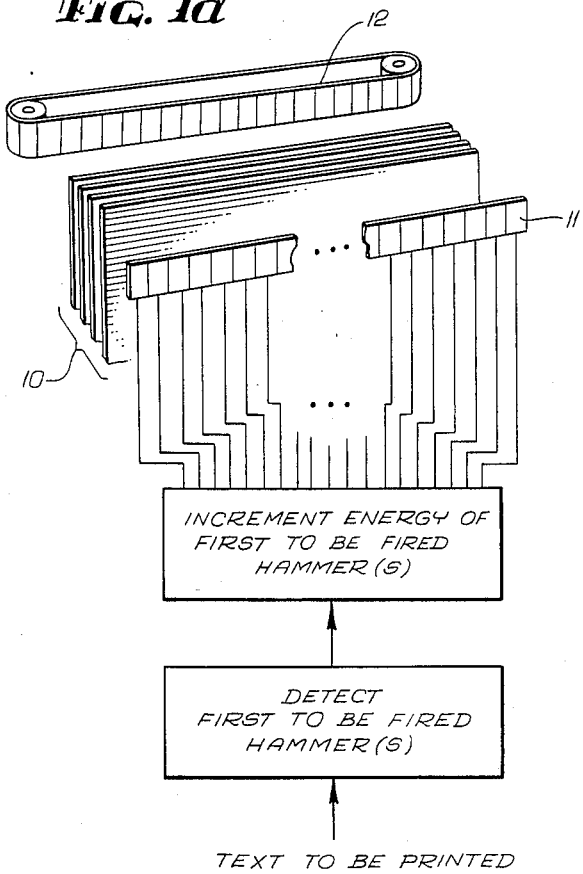
FIG. 1*a* shows a conceptual level block diagram of the present invention of boosting first print hammer(s) drive current in order to obtain uniform print density and registration in an impact printer.
Figure 1B:
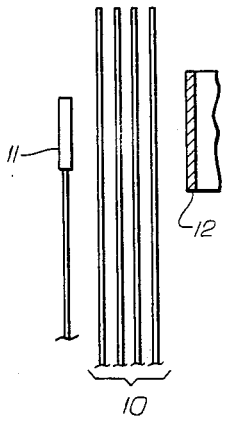
FIG. 1*b* shows a pictorial top view of the impact printing of a multi-part form.

A conceptual level block diagram of the function of the present invention is shown in FIG. 1. A typical band-type impact printer is illustrated in FIG. 1*a*. A side view of the position of a paper form, nominally multi-part paper form 10, relative to hammers 11 and band 12 is shown in FIG. 1*b*. The present invention functions to effect the printing of the TEXT TO BE PRINTED through DETECT[ing] FIRST TO BE FIRED HAMMER(S) in the impact printing of such text. Subsequent to detecting, the invention functions to INCREMENT ENERGY OF FIRST TO BE FIRED HAMMERS thereby causing that a selected one(s) of print hammers 11 will receive more energy to compress, and to print, paper form 10 against print band 12.

Figure 2:
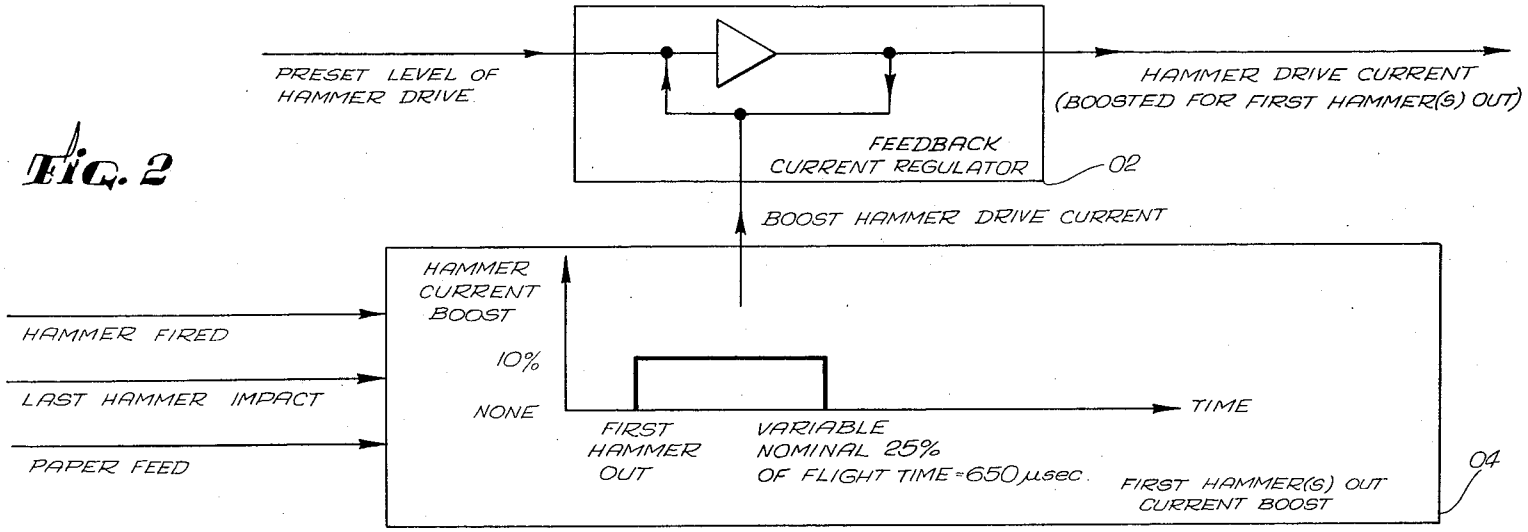
FIG. 2 shows an engineering level block diagram of an apparatus constructed in accordance with the present invention for boosting first print hammer(s) drive current in order to obtain uniform print density and registration in an impact printer.

Pictorial representations of the dual problems of character displacement and of print density dealt with by the present invention are respectively shown in FIG. 1*c*1 and FIG. 1*c*2. For the three lines shown in FIG. 1*c*—LINE 1 and LINE 2 and LINE 3—it may be imagined that the left most character "H" shown in each line is the first character printed within such line. It may be noted in line 2 that the character "H" is horizontally displaced relative to the occurrence of the identical character "H" in LINE 1 and in LINE 3. Although it might well be envisioned that the first character "H" in both LINE 1 and in LINE 3 is likewise displaced, it is evident that the most visually severe misalignment, or misregistration, problem occurs by the comparison of the character "H" in LINE 2 to the like characters in LINE 1 and in LINE 3. The displacement of the character is especially noticeable because of the vertical line component therein, such as is typical of characters like "F", "L", and "T". The misregistration shown in FIG. 1*c*1 is particularly typical of single-part paper forms, and occurs because the print hammer first impacting such form upon each print line must press such form against the character font, dissipating energy and registering the character at an alternative position than such would have been registered by a later struck hammer upon such time as the form was already in compression against the print character font.

Likewise, the problem with non-uniform print density in an impact printer is illustrated in FIG. 1*c*2. Within each of LINE 1, LINE 2 and LINE 3 the leftmost "A" may be considered to be the first printed in time, and, the print band moving to the right, the letter "A" in the second column may be considered to be printed upon a next subsequent print interval, further continuing to the "A" in the third column which is printed upon a third print time interval. It is intended to illustrate in FIG. 1*c*2 that the density of the printed "A" becomes successively greater, until upon some subsequent printing of this character (or any other) at some subsequent print time then the print density will achieve substantial uniformity. The reason that the light character, the light "A", occurs at the first position printed is that the energy in the print hammer impacting such position at the first print time interval is dissipated in compression of a paper form. The phenomena of non-uniform print density exhibiting lightly printed characters illustrated in FIG. 1*c*2 is particularly prominent on multi-part paper forms. Both the problems shown in FIG. 1*c*1 and in FIG. 1*c*2 are dependent upon the font velocity and font size, being more evident at higher band or drum speed wherein the print hammer is necessarily forcing the form in contact with the character font during the printing operation for a minimum period of time. The problems of print character registration and print character density respectively shown in FIG. 1*c*1 and FIG. 1*c*2 can actually become one of the primary limiting factors which preclude that impact printers should be operated at ever increasing speed, precluding that the print hammers of such printers should compress and print a paper form against a moving print font at ever faster rates and shorter time intervals. The proper registration and the proper density obtained by the present invention is shown in FIGS. 1*d*1 and 1*d*2.

A block diagram of an apparatus constructed in accordance with the present invention is shown in FIG. 2. A PRESET LEVEL OF HAMMER DRIVE which is normally set by the operator in consideration of the density, thickness, and numbers of copies of the forms being printed, is amplified, nominally in a FEEDBACK CURRENT REGULATOR 02, in order to produce a HAMMER DRIVE CURRENT which is distributed to all print hammers in parallel. Specific ones of such print hammers are actuated by logics in the printer at specific print interval times during the print cycle in order that they may contact a specific character font upon a moving media, such as a print band or print drum, disposed at a specific time oppositely to such print hammers. These logics selectively complete a path to current ground through selected print hammers at, and during, selected print interval times. By such a procedure the well known function of a band, or drum, impact printer is realized.

Continuing in FIG. 2, in accordance with one preferred embodiment implementation of the present invention, circuit FIRST HAMMER(S) OUT CURRENT BOOST 04 does establish that a signal BOOST HAMMER DRIVE CURRENT shall be provided to the FEEDBACK CURRENT REGULATOR 02 upon the time of the firing of the first print hammer(s) out on each print line. Such signal BOOST HAMMER DRIVE CURRENT nominally connects to the feedback path within FEEDBACK CURRENT REGULATOR 02, causing such current regulator to produce an augmented drive signal which is the HAMMER DRIVE CURRENT (BOOSTED FOR FIRST HAMMER(S) OUT). In the actual operation of the circuit FIRST HAMMER(S) OUT CURRENT BOOST 04, signal HAMMER FIRED related to the occurrence of a first print hammer firing upon each print cycle, signal LAST HAMMER IMPACT relational to the end of a print cycle, and signal PAPER FEED relational to the time at which the paper form is being advanced and printing is not transpiring—all of which signals are obtained from and normally available within the logics of an impact printer—will be logically combined in order to establish an interval of time during which the print hammer drive current will be boosted.

As evidenced by the graphically displayed transform function within the circuit FIRST HAMMER(S) OUT CURRENT BOOST 04, the magnitude of the HAMMER CURRENT BOOST will be 10%, commencing at the FIRST HAMMER OUT and extending for an interval of time which is VARIABLE, NOMINALLY 25% OF FLIGHT TIME=650 MICROSECONDS. This transfer function displayed in FIG. 2 is that nominally occurring for a (1) band printer, with the (2) PRESET LEVEL OF HAMMER DRIVE set to a minimum which is particularly suitable for a single part paper form, and with (3) a hammer flight time of 2.6 milliseconds which is typical of a 900-line-per-minute impact printer. Other transfer functions are possible in the boosting of print hammer drive current, and other forms of interconnection to an amplifier, or power supply, are possible alternatively to that current boost transfer function, and that interconnection, which are shown in FIG. 2. The pictorial showing of FIG. 2 should be understood to be representative of one preferred embodiment implementation of the present invention only, and not to depict or limit the sole electrical structures or design parameters which may be employed in alternative embodiments of such invention.

Figure 3:
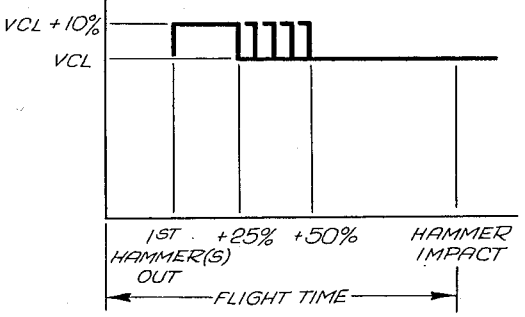
FIG. 3 shows a graphic representation of the boost in print hammer drive current occurring during the flight time of the first print hammer(s) out.

A graphical representation of the boost provided to the print hammer drive current during the actuation of a first print hammer(s) during the printing of each line by an impact printer employing the present invention is shown in FIG. 3. The normal level of the PRINT HAMMER DRIVE VOLTAGE which is provided to all print hammers in parallel is shown as voltage level VCL. Of course, the individual hammer drive current will depend upon whether such individual print hammer is actuated, and the collective print hammers' drive current will, at any one time, depend upon the total numbers of print hammers as are at that time actuated. Howsoever many print hammers are actuated, or simultaneously actuated, the power supply to such print hammers does maintain voltage level VCL.

In the preferred embodiment of the invention, to be explained in conjunction with the timing diagram of FIG. 5, up to 136 print columns can conceivably, the character fonts disposed relative to each such column permitting, be printed in as little as one print interval time of 692 microseconds for a 900-line-per-minute printer. Normally, only a few print hammers are actuated during each print interval time, of which the print interval times there are normally so many in number as there are characters in a character set upon the band or drum and printable by the printer. An exception to the uniform maintenance of HAMMER DRIVE VOLTAGE at level VCL occurs upon the occasion of the 1st HAMMER(S) OUT. Before this time, which can occur at any print time interval within a print cycle but which time can occur only once for any line upon which printing transpires at all, the level of the PRINT HAMMER DRIVE VOLTAGE to the hammer or hammers printing is elevated to VCL+10%. Of course, no print hammer is actuated, availing itself of the boosted drive derived from the elevated voltage, until the print interval of 1st HAMMER(S) OUT.

This elevated level of the HAMMER DRIVE VOLTAGE is maintained for a proportion of the FLIGHT TIME interval ranging from +25% to +50% of such interval The alternative time within the range of +25% to +50% of the FLIGHT TIME interval at which the PRINT HAMMER DRIVE VOLTAGE is reduced from VCL+10% to VCL is illustrated by the several curves in FIG. 3, and is determined, by the circuit of the present invention which will be shown in FIG. 7, relative to the nominal level of the PRINT HAMMER DRIVE VOLTAGE VCL which is being employed In particular, this level VCL of the HAMMER DRIVE VOLTAGE will be predetermined by an operator setting in consideration of the type, thickness and numbers of parts of the form being printed. In any case, it should be understood from FIG. 3 that the boost in the HAMMER DRIVE VOLTAGE, and in the hammer's(hammers') drive current will not be for entire of the hammer FLIGHT TIME, but will be for a maximum of 50% of such FLIGHT TIME. Such hammer FLIGHT TIME is nominally 2.6 milliseconds for a 900-line-per-minute printer, or, as represents a different physical type of hammer, nominally 3.35 milliseconds for a 300- or 600-line-per-minute printer.

Figure 4:
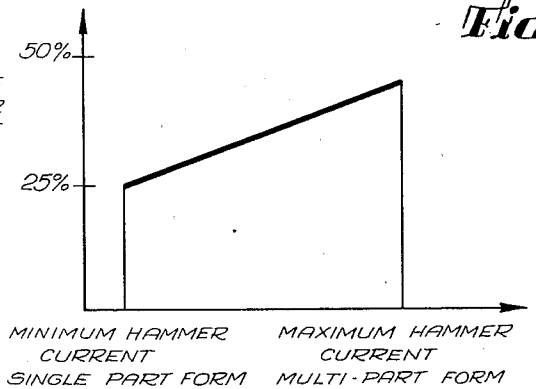
FIG. 4 shows a graphic representation of the percentage of flight time for which current is boosted versus the preset print hammer drive current level.

Further to this concept shown in FIG. 3 that the PRINT HAMMER DRIVE VOLTAGE, and the hammer current resultant therefrom, may be boosted for a varying time ranging, from 25% to 50% of the FLIGHT TIME interval, a graphical representation of such PERCENTAGE OF FLIGHT TIME FOR WHICH CURRENT IS BOOSTED (BY 10%) is shown in FIG. 4. It may be observed that for MINIMUM HAMMER CURRENT (corresponding to) SINGLE PART FORM the PERCENTAGE OF FLIGHT TIME FOR WHICH CURRENT IS BOOSTED is 25%. Alternatively, for MAXIMUM HAMMER CURRENT (representative of a) MULTI-PART FORM, then the PERCENTAGE OF FLIGHT TIME FOR WHICH CURRENT IS BOOSTED is 50%. Therefore, in accordance with the present invention when the preset nominal print hammer drive voltage, or current, is lower as besuits single-part forms, then the duration of the boost applied to such voltage, or current, is likewise minimal. Conversely, when the preset nominal print hammer drive current is larger, as besuits the printing of multi-part forms, then the duration of the boost voltage, or current, applied to first actuated print hammers is of longer duration and greater percentage of the print hammer flight time interval.

That this should be the preferred relationship is not obvious. For example, if it is even perceived that the level of boost to be applied should be variable at all, and that such should be variable in accordance with the preset of the nominal print hammer drive voltage (current) occurring by operator entry relational to the form being printed (as opposed, for example, to a separate operator entry), then it is still not obvious that the parameter of boost operation which should be modified is the duration of the application of such boost (from 25% to 50%) and not the magnitude of such boost (which remains constant at 10%). Experimentation and empirical observation are involved in derivation of both the 10% boost level and the recognition that such should be variably applied for an initial portion (only) of the flight time interval ranging from 25% to 50% of the total flight time interval. To the extent that this empirical investigation needs be repeated for printers of diverse characteristics employing the present invention, it should be recognized that it is important in such investigation to study the font velocity relative to the hammer velocity at impact. Particularly, it is desirous that the hammer(s) first fired during each print interval should have an equal velocity upon final displacement of the form into the font as do later fired hammers have at the same point of printing. Since the font velocity, upon a band or upon a drum, is not appreciably affected by the progression of the print cycle, nor by the number of parts within the form being printed, nor by the compression of such form, then the controllable factor is most appropriately the print hammer flight velocity. The scheme of application of drive current boost shown in FIG. 3 and FIG. 4 is tailored to obtain best results on a 900-line-per-minute band printer printing commonly used paper forms. Measurements, and parameters, of boosted hammer operation taken scientifically may be augmented by empirical observation of print results obtained.

Figure 5A:
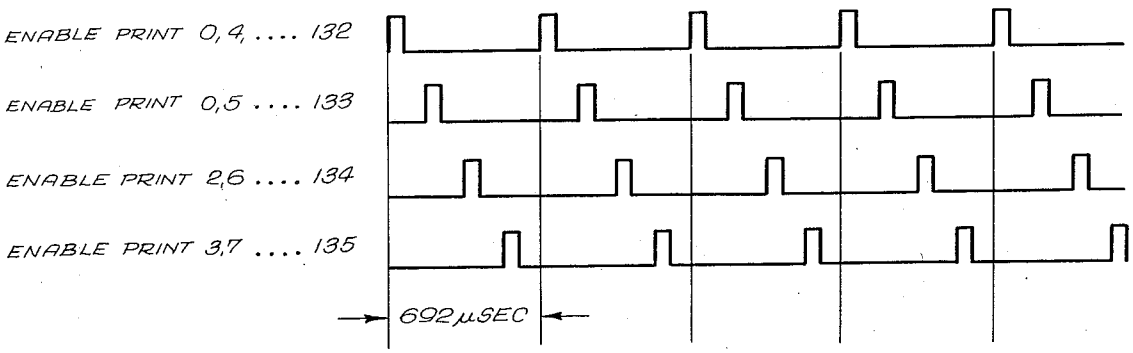
FIG. 5*a* shows typical print hammer timing in an impact printer phasing at four times the strikes of print hammers during each minor print time interval.

A timing diagram for a 900-line-per-minute impact printer in which the preferred embodiment of the invention is located is shown in FIG. 5*a*. At 900 lines per minute, the total print time for each line is 60/900 seconds, or approximately 66.7 milliseconds. Of such total 66.7 milliseconds print time, nominally 20 milliseconds are used for paper feeding, leaving an interval of 46.7 milliseconds during which all characters upon a print line must be printed. The printer is nominally capable of printing a full ASCII character set consisting of 64 characters, and thus potentially requires up to 64 minor cycle, print interval, times within the overall 46.7 millisecond print cycle in order to so print up to 64 characters. In actuality, there are an additional three minor cycle times, or print intervals, used for synchronization within the print cycle. Consequently, a 46.7 millisecond print cycle interval is divided into 67 equal parts, each of approximately the 692 microseconds duration illustrated in FIG. 5*a*. Such 692 microseconds is one print time interval. At each one print time interval the print hammers which must be fired to print a then oppositely juxtaposed print font in accordance with the print character to be printed at that location will be fired. As few as none, or as many as all of the print hammers may be fired within one print time interval, or 692 microseconds. The 692 microsecond minor print cycle, or print interval, is divided into four 173 microsecond subintervals upon which the enabling print signals for every fourth character position will be staged. As illustrated, the signal ENABLE PRINT 0,4, . . . 132 will enable that a first bank of hammers should commence movement toward printing up to 34 print positions at zero elapsed time into the 692 microsecond print time interval, whereas signal ENABLE PRINT 1,5, . . . 133 will commence the actuation of up to an additional 34 print hammers bank some 173 microseconds later, and so on.

Such staged actuation of print hammers within a minor print cycle, or print interval, is not essential to the present invention. However, it may be understood as illustrated by example in FIG. 5*a* and FIG. 5*b* that earlier firing print hammers will obtain relatively more boost than later firing print hammers within the boost interval, and print hammers firing after the expiration of such interval will receive no boost at all. For example, in FIG. 5*b* it is suggested that hammers do fire at a first print time subinterval from hammers 1 (print position 0, 4, . . . 132), 2 (print position 1, 5, . . . 133), and 4 (print position 3, 7, . . . 135), all upon a first print time interval. Further, and though it needs not necessarily be so, it is shown in the example of FIG. 5*b* that the fourth, fifth, sixth and seventh hammer(s) firings occurring during a second 690 microsecond print interval do also involve, at successively phased subintervals within such interval, hammers 1, 3, 4 and 1.

Figure 5B:
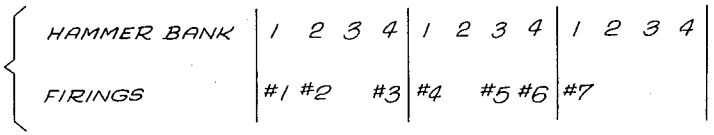
FIG. 5*b* shows an example of a sequence of print hammer firings based on the printer timing shown in FIG. 5*a*.
Figure 5C:
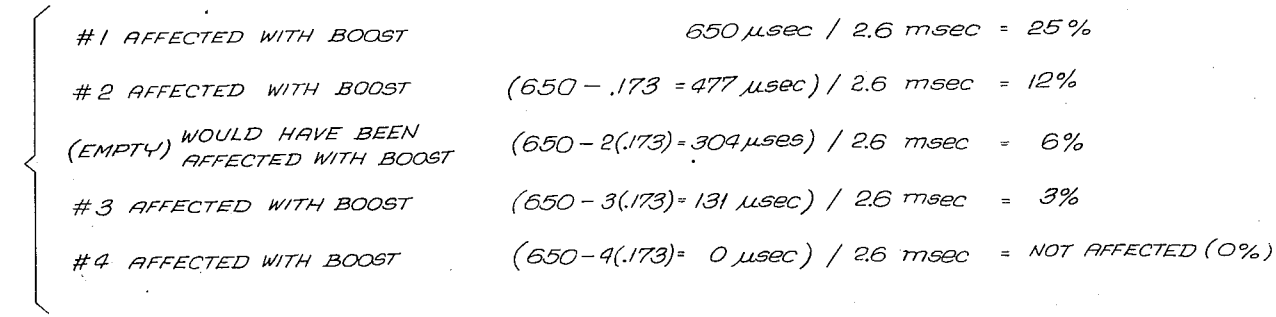
FIG. 5*c* shows an analysis of the times over which print hammer current is minimally boosted in accordance with the example print hammer firings shown in FIG. 5*b*.

Assuming that the hammer flight time within the 900-line-per-minute printer is equal to 2.6 milliseconds, and that the hammer current is adjusted for the minimum (single-part form) causing that a current boost will be applied for 25% of such flight time, or 650 microseconds, then the effect of such current boost upon the example firing shown in FIG. 5*b* is in accordance with the analysis shown in FIG. 5*c*. The first hammer or hammers ever fired, in other words those at print positions 0, 4, . . . 132, are affected with a boost of exactly 650 microseconds, or 25%, of their 2.6 millisecond flight time. The time during which the hammers associated with the second firing interval are boosted is, however, reduced by the phase delay in the enablement of the print hammers within such hammer bank. By reference to FIG. 5*a*, this phase delay subinterval in enablement of the print hammers may be observed to be 692/4 microseconds, or 173 microseconds. Therefore, in accordance with the analysis shown in FIG. 5*c*, the latter-fired print hammers, although still within the first print time interval, do receive boost for but 477 microseconds of their total 2.6 milliseconds flight time. The continuing analysis in FIG. 5*c* shows that in the third print time interval which is empty of hammer firings, and during which the 3rd set of hammers would have been fired should the proper character have then appeared at any of the print positions (2,6, . . . 134), would have been affected with a boost for 304 microseconds. The last fired hammers (print position 3,7, . . . 135) within the first print time interval will have that the one or more hammers fired shall receive current boost for the first 131 microseconds of their 2.6 millisecond flight time. Finally, note by the continuing analysis of FIG. 5*c*, that no subsequent hammer firing, howsoever early occurring within a next subsequent print interval, will receive a current boost. Similarly to FIG. 5*c*, FIG. 5*d* shows an analysis of the current boost provided to up to a first eight print hammers when the level of boost is set at a maximum suitabale for multi-part forms At such a setting, for example in the printing of six-part forms. At such a setting, for example in the printing of six-part forms, the first boosted hammer(s) would receive a current boost for 50% of its flight time with the print hammers fired at up to seven subsequent print intervals also receiving a current boost.

The summary teaching of FIG. 5 is that although all of the one or more hammers as are associated with one or more print cycles which are enabled to be fired during a first print time interval (at which any hammers are fired) will receive a current boost. The time of the hammer flight over, and during, which such first-fired one or more print hammers will receive such current boost varies. The time varies with the positions of such hammers within the 136 position print line and with the corresponding subinterval at which such print hammers are enabled to be fired. Thus, the earliest fired print hammers, which contact the paper form first and which loose the most energy to the compression of such paper form, receive the highest energy boost. This is the desired relationship: those print hammers which need the greatest boost receive such greatest boost. Those print hammers which are fired closely proximate in time, and which still need boost to overcome a paper form which is, as yet, not fully compressed, receive correspondingly less boost as they are more distant in time from the initiation of the flight of the first hammer actuated during the printing of each print line.

A timing diagram for signals of pertinence to the present invention is shown in FIG. 6. A corresponding schematic of a preferred embodiment circuit apparatus of the present invention is shown in FIG. 7. In a 900-line-per-minute printer having an approximately 66.7 millisecond line print time, signal PAPER FEED shown in FIG. 6 is high for approximately 20 milliseconds during the feeding of the paper form. The remaining 46.7 milliseconds of the line print time is the print cycle, as evidenced by the high condition of signal PRINT. The signal LAST HAMMER IMPACT (DELAYED) is a signal which is low-going at the time of the impact of the last hammer used in any print line (which impact occurs during the print cycle represented by the high condition of signal PRINT) delayed into the paper feed interval, represented by the high condition of signal PAPER FEED. Logical combination of this signal and signal PAPER FEED will be seen, in the logic circuit shown in FIG. 7*b*, to produce signal ENABLE BOOST which goes low in order to enable and initiate the boosting of print hammer current in accordance with the present invention.

Continuing in FIG. 6, at a latter time, which latter time may be and which is illustrated to be well into the print cycle represented by the high occurrence of signal PRINT, the received signal (FIRST) HAMMER FIRING goes low, and remains that way, during the duration of the firing of successive hammers during printing. The signal is actually derived from a digitized signal of the hammer waveform and is normally and commonly available for control purposes in impact printers. Although the HAMMER VOLTAGE SIGNAL has been enabled to rise to 110% of its normal value, meaning 110% VCL as opposed to VCL, by the low-going occurrence of signal ENABLE BOOST, there is, until the time of the first firing of print hammers upon each print line as represented by the low-going condition of signal (FIRST) HAMMER FIRING, no print hammer actuation which does avail itself of this boosted level of HAMMER VOLTAGE. When, however, the first hammers on a print line do commence actuation as represented by the low-going occurrence of signal (FIRST) HAMMER FIRING, then the logic of the present invention shown in FIG. 7*b* will establish that a timer is set, the duration of which is represented by the high occurrence of signal BOOST TIMER. At the expiration of this timer, and upon the low-going occurrence of signal BOOST TIMER, the boost of the HAMMER VOLTAGE will be disabled, and such HAMMER VOLTAGE will return to its normal quiescent level VCL. The logic apparatus which does effect the interrelationship between signals shown in FIG. 6 will be observed during the discussion of FIG. 7.

Figure 7A:
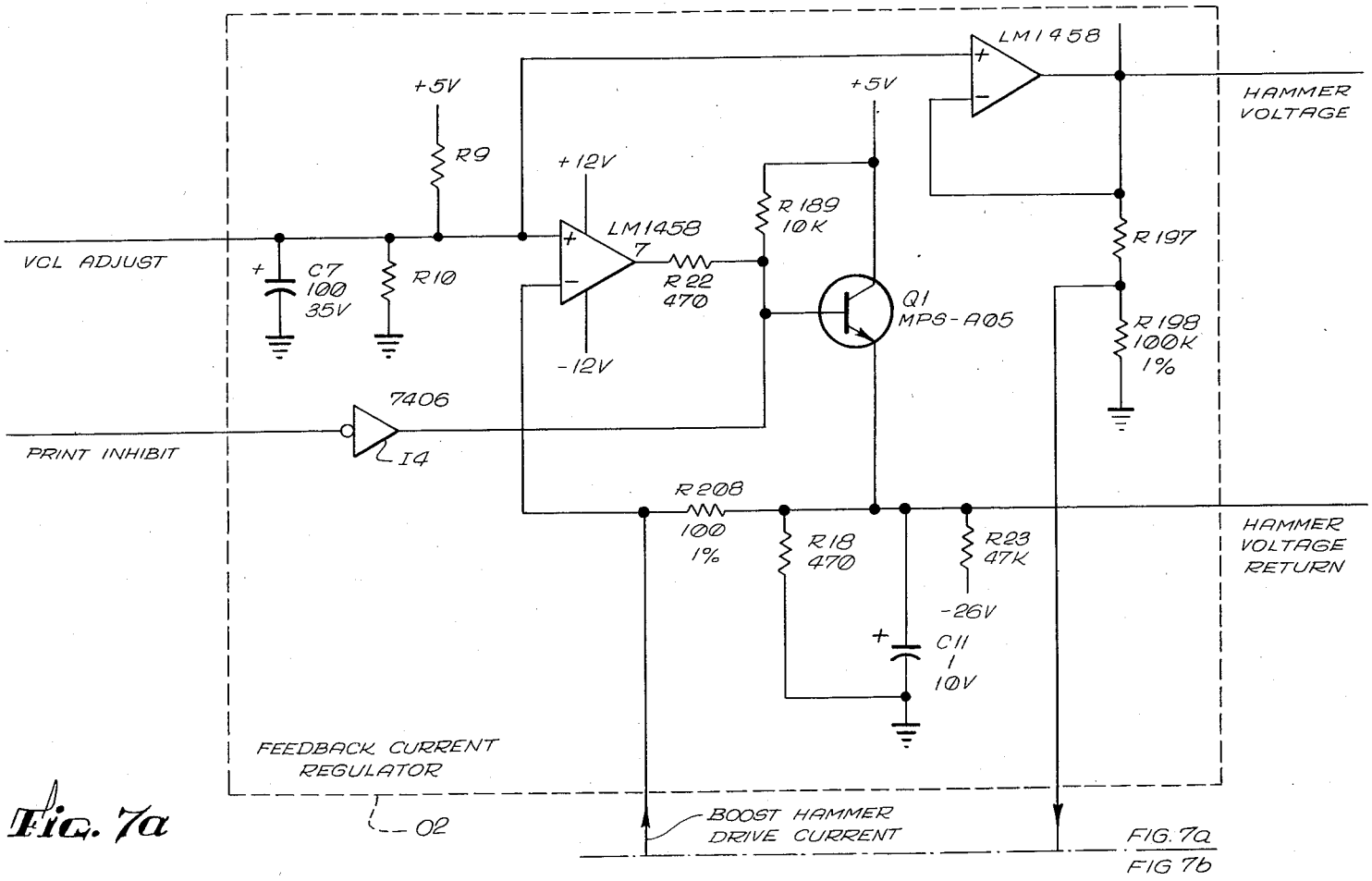
FIG. 7, consisting of FIG. 7*a* and FIG. 7*b*, shows a schematic diagram of the circuit of the present invention for boosting the print hammer drive current for the first print hammer(s) out on each print line in an impact printer.
Figure 7B:
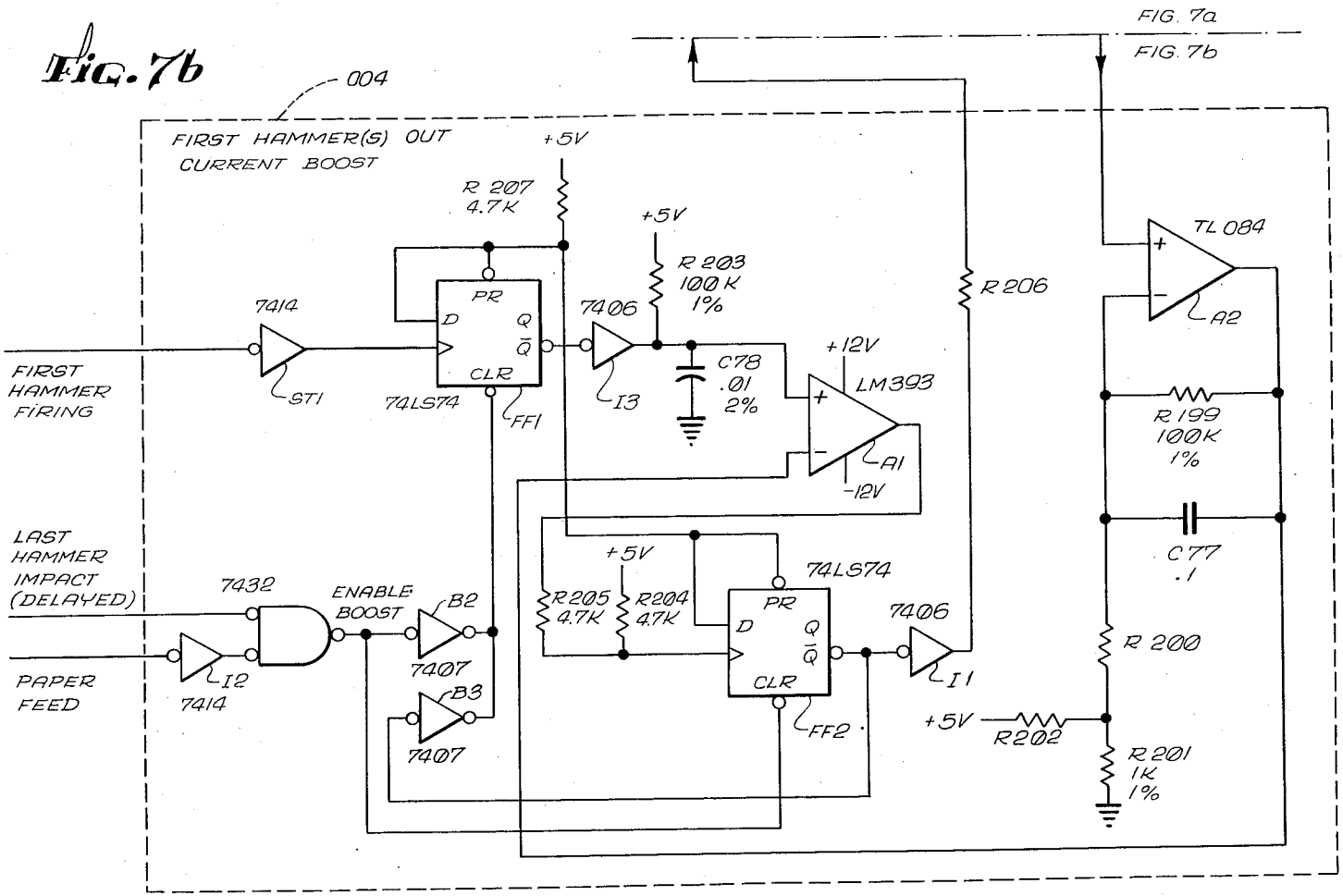

The schematic diagram of the circuit of the present invention is shown in FIG. 7. The FEEDBACK CURRENT REGULATOR 02 shown in FIG. 7*a*, and previously seen in FIG. 1, is an existing circuit within an impact printer to which the FIRST HAMMER(S) OUT CURRENT BOOST circuit 04 shown in FIG. 7*b*, and previously seen in FIG. 1, does connect. The connection between the two circuits is by signal BOOST HAMMER DRIVE CURRENT, previously seen in FIG. 1. By this signal the boosting of the HAMMER VOLTAGE, and associated hammer current, to the print hammers is caused to incur upon the appropriate time at the actuation of a first print hammer(s) upon each print line. A further signal is communicated, proportional to such HAMMER VOLTAGE developed by the FEEDBACK CURRENT REGULATOR 02 back to the FIRST HAMMER(S) OUT CURRENT BOOST circuit 04. This signal is for the purpose of affecting that such circuit 04 should enable the boosting of hammer drive circuit for a variable interval dependent upon the normal, quiescent, level of hammer drive (which variable duration of boost was observed in FIG. 3 and FIG. 4).

Considering first the existent FEEDBACK CURRENT REGULATOR 02 shown in FIG. 7*a*, such circuit will produce a HAMMER VOLTAGE of a predetermined level from approximately 1.4 VDC to 1.8 VDC. The predetermination of the level to be supplied is in accordance with signal VCL ADJUST, itself nominally of 1.4 to 1.8 VDC. The signal VCL ADJUST arises from a variable resistance set by an operator in accordance with a dial indicator upon a control panel. Such dial nominally indicates 16 equal increments of print density control, and the operator will establish lower settings for lighter, single-part, print forms and higher settings with denser, multi-part, print forms. The operator predetermined level of signal VCL ADJUST will be amplified in the FEEDBACK CURRENT REGULATOR 02, consisting essentially of operational amplifiers type LM 1458 and associated circuitry in order to provide a high current capacity drive signal to all print hammers in parallel. A higher, 1.8 VDC level, of signal HAMMER VOLTAGE will cause the print hammers to strike harder, which is appropriate to the printing of multi-part forms, whereas a lower, 1.4 VDC, level of signal HAMMER VOLTAGE will cause the print hammers to strike less hard as is appropriate to the printing of a lighter, single-part paper form.

Signal PRINT INHIBIT, high going when it is desired to inhibit print operations as during printer tests or upon the occurrence of printer faults, is inverted in inverter I4 type 7406 and applied to the base of transistor Q1 to turn on such transistor Q1, thereby disabling the feedback path of the HAMMER VOLTAGE RETURN within the FEEDBACK CURRENT REGULATOR 02 and disabling that any voltage, or current, should be supplied to the print hammers. Forebearing that such signal PRINT INHIBIT is high, the FEEDBACK CURRENT REGULATOR 02 does have a feedback path of signal HAMMER VOLTAGE through the print hammers which it does energize returning as signal HAMMER VOLTAGE RETURN. Such feedback path, observed to proceed through resistor R208, will maintain an essentially equal HAMMER VOLTAGE, and consequent individual print hammer current, howsoever many print hammers do simultaneously fire upon each print interval time.

The interaction of the FIRST HAMMER(S) OUT CURRENT BOOST circuit 04 shown in FIG. 7*b* with the existent circuit of the FEEDBACK CURRENT REGULATOR 02 shown in FIG. 7*a* is straightforward. The signal BOOST HAMMER DRIVE CURRENT is, by such operation of the circuit as will be discussed, of a low condition during times when the application of a boost to the current drive resultant from signal HAMMER VOLTAGE is not enabled. This level of signal BOOST HAMMER DRIVE CURRENT received at the feedback path of the FEEDBACK CURRENT REGULATOR 02 will have no effect upon the operation, or the HAMMER VOLTAGE produced by operation, of such FEEDBACK CURRENT REGULATOR 02. The HAMMER VOLTAGE output therefrom will remain at its normal, quiescent, level of VCL (shown in FIG. 7*a*).

The low condition of signal BOOST HAMMER DRIVE CURRENT is enabled by the satisfaction of OR gate G1, type 7432, which satisfaction will occur at all times save when signal LAST HAMMER IMPACT (DELAYED) is low simultaneous that signal PAPER FEED is high. The high condition of signal ENABLE BOOST output from satisfied OR gate G1 is received at the clear, CLR, input to dual D positive edge-triggered flip-flop FF2, type 74LS74, and will accord that such flip-flop FF2 will hold that condition, set or clear, which was previously assumed. By operation of the circuit as will be discussed, the condition of flip-flop FF2 post the period of enabling current boost will be the clear condition, resulting in the maintenance of a high clear, or $\overline{Q}$, signal output This high signal is inverted in inverter Il, type 7406, and applied through resistor R206 as the low condition of signal BOOST HAMMER DRIVE CURRENT. The high condition of signal ENABLE BOOST will likewise establish the clear condition of dual D positive-edge-triggered flip-flop FF1 type 74LS74.

The commencement of the application of current boost, enabled by the high condition of signal BOOST HAMMER DRIVE CURRENT, begins with the dissatisfaction of OR gate G1. Dissatisfaction of OR Gate G1, type 7432, is required to produce the low condition of signal ENABLE BOOST. Such dissatisfaction of AND Gate T1 is enabled by the high occurrence of signal PAPER FEED during the paper feeding portion of the print line time inverted in inverter I2 type 7414 and applied to the OR gate G1 in conjunction with the low occurrence of signal LAST HAMMER IMPACT (DELAYED). This signal LAST HAMMER IMPACT (DELAYED) represents the delayed occurrence of the low signal resultant from the firing of the last hammer within the print cycle of the previous line print time. The low signal resultant from satisfaction of OR Gate G1 is received as the clear, CLR, input into dual D positive-edge-triggered flip-flop FF2 type 74LS74 simultaneous with the high preset, PR, input to such flip-flop. The low clear, and high preset, signals in combination do clear such flip-flop FF2, producing a high clear side $\overline{Q}$ signal output therefrom. This high signal is inverted in inverter Il type 7406 and applied to resistence R206 as the low condition of signal BOOST HAMMER DRIVE CURRENT. The low condition of this signal BOOST HAMMER DRIVE CURRENT will cause that FEEDBACK CURRENT REGULATOR 02 should boost the output of the signal HAMMER VOLTAGE by approximately 10%. The duration of this boost will be for so long as the signal BOOST HAMMER DRIVE CURRENT does remain low.

Continuing in FIG. 7*b*, it may be noted by momentary reference to the timing diagram of FIG. 6 that the signal LAST HAMMER IMPACT (DELAYED) does return to the high condition, satisfying two-input OR Gate G1 and producing the high condition of signal ENABLE BOOST. This high condition of signal ENABLE BOOST is communicated through open-collector high-voltage output noninverting buffer B2, type 7407, to the clear, CLR, input to dual D positive-edge-triggered flip-flop FF1, type 74LS74. Meanwhile, the continuing high signal output of the clear, $\overline{Q}$, side of flip-flop FF2 which is buffered in open-collector high-voltage output non-inverting buffer B3, type 7407, and applied to the same clear CLR input of flip-flop FF1. Upon the low occurrence of signal (FIRST) HAMMER FIRING, representing that a first firing of a print hammer(s) within a printed line has occurred, such signal will be inverted and stretched by Schmidt trigger ST1, type 7414, and applied as a high signal to the clock input of flip-flop FF1. During the continuing high presence of the clear, CLR, signal to such flip-flop FF1, the high occurrence of the clock signal will enable the flip-flop to respond to the high set, D, side signal input, and become set. In such a set condition of flip-flop FFl the clear, $\overline{Q}$ signal output goes low. This low clear, $\overline{Q}$, side signal output of flip-flop FF1 is inverted in the open-collector high-voltage-output inverting buffer I3, type 7406, and applied to charge a resistance and capacitance network consisting of resistance R203 and capacitance C78. This resistance and capacitance network will charge at a rate representative of the drive current provided by the industry standard 7406 part. It will gradually assume a sufficiently positive level at the plus +, input to comparator type LM393 relative to the differential minus, −, input to the same comparator so as to allow the comparator to develop a positive voltage output signal. This signal, when communicated to flip-flop FF2 will be sufficient to clock such flip-flop.

Note at this point that the minus, −, input to comparator A1 type LM393 is derived from the signal output of operational amplifier A2, type TL084. This signal output is itself derived from a plus, +, signal input to such amplifier A2, which signal input is proportional to the signal HAMMER VOLTAGE which is developed by the FEEDBACK CURRENT REGULATOR 02. Since this signal HAMMER VOLTAGE which is developed by FEEDBACK REGULATOR 02 is proportional to the signal VCL ADJUST, and since the signal VCL adjust is predetermined by the operator in consideration of the thickness and parts of the forms being printed, then the signal produced by operational amplifier A2, and received at comparator A1, will be proportional to this predetermined setting. Consequently, this proportionality, in combination with the fixed signal rise time resultant from the resistor-capacitor network consisting of elements R203 and C78 driven by inverting buffer I3, will make that the time at which the signal output of operational amplifier A1 will become sufficiently positive so as to clock flip-flop FF2 will be a function of (1) the preselected components of the resistive and capacitive circuit which is charged, and (2) the predetermined adjustment as to the number of forms parts being printed by the operator.

In this manner, the circuit of the present invention is effective to boost the drive current for a longer period of time upon operator preselection of a higher number of form parts corresponding to a higher preselected drive current (voltage), or to boost the drive current for a shorter duration of time if such preselection of the number of form parts, and corresponding hammer drive current (voltage), is lower. The actual circuit components shown will produce a time interval of approximately 50% of hammer flight time, or 1.3 milliseconds, when the signal HAMMER VOLTAGE is nominally (unboosted) at a level of 1.8 volts. Alternatively, when the level of such signal HAMMER VOLTAGE is 1.4 volts, the circuit shown will produce a time period of approximately 650 microseconds, which is 25% of the hammer flight time of 2.6 milliseconds.

Continuing in FIG. 7*b*, the signal output of the comparator A1 will, after a duration of time in the range of 650 microseconds to 1.3 milliseconds, assume a sufficiently positive level so as to clock flip-flop FF2. This clocking of flip-flop FF2 will, in the presence of the high set D, side signal input, enable such flip-flop FF2 to become set therein producing a low clear side, $\overline{Q}$, signal output. This low clear, $\overline{Q}$, side signal output is inverted in open-collector high-voltage-output inverting buffer I1, type 7406, and applied through resistance R206 as the high signal BOOST HAMMER DRIVE CURRENT to the feedback loop of the FEEDBACK CURRENT REGULATOR 02. Such high signal will be overridden by the normal low condition of this feedback loop, and will have no effect upon the level of signal HAMMER VOLTAGE as is developed by such FEEDBACK CURRENT REGULATOR 02.

Consequently, by operation of the circuit FIRST HAMMER(S) OUT CURRENT BOOST 04, the signal HAMMER VOLTAGE developed by circuit FEEDBACK CURRENT REGULATOR 02 has been boosted for a fixed period of time and, by selection of the component value of resistance R206 versus that resistance R208 within the normal feedback current path, for a fixed amount Within the preferred embodiment of the present invention shown in FIG. 7, such boost will occur for a time period between 650 microseconds and 1.3 milliseconds depending on the setting of signal VCL ADJUST. The amount of the boost will be constant, regardless of the duration of the boost, at a level equal to 10% of signal HAMMER VOLTAGE.

Finally in FIG. 7*b*, the low occurrence of the clear, $\overline{Q}$, signal output of flip-flop FF2 will be communicated through open-collector high-voltage output non-inverting buffer element B3 type 7407 and received as a low signal into the clear, CLR, input to flip-flop FF1, therein clearing such flip-flop FF1. Since signal ENABLE BOOST had previously returned to the high condition, flip-flop FF2 will remain in the clear condition, and will not reset, so as to allow reinstitution of the current boost, until the cycle next begins again upon the low going condition of signal ENABLE BOOST.

In summary, the preferred embodiment implementation of the electrical apparatus of the present invention has been seen to be a circuit of predominently analog characteristics. A simple logical control of two flip-flops controls the time and duration of actuation of analog circuits in order to produce, at the time of the firing of a first print hammer during each print line, a 10% current boost. It should immediately be recognized that much greater sophistication could be applied to the digital initialization and/or durational control of the analog elements of the present circuit than is evidenced by that rudimentary digital control shown in FIG. 7*b*. For example, the concept of the invention could be further extended to selective reenablement of the current boost if the hammers within a print line were not fired continuously, or suitably proximate in time. In such an event of early hammer(s) firing(s), followed by a period of idleness prior to the later firing of an additional hammer(s), then the paper form could relax, re-instituting the "first-hammer out" syndrome, between the earlier and later hammer(s). Further, even those print hammers which are fired continuously, but which are fired at some distance apart upon a very large dimension printed form, could still, in distant parts of such printed form, exhibit the undesirable "first-hammer out" syndrome. The obvious way to overcome both problems is by greater sophistication of control, selectively reenabling the boost if the time gap between sequentially fired hammers is too long, and/or the physical separation of print hammers is so great that print hammers fired at one location upon a paper form cannot be considered to reliably compress the entire paper form. The manner of obtaining such greater sophistication in the control of the print hammer current boost is by using microprocessors to monitor signals indicating print hammer firing across the entire time of printing, and for indicating the hammer firings several physical sections across a hammer bank. It could be envisioned that the ultimate adaptive printing scheme would selectively control the current to be applied to each single hammer in consideration of the priorly, and concurrently, occurring activity of all neighboring hammers to such hammer. Such extreme sophistication is, however, not generally required to obtain satisfactory results, the apparatus of the present invention in its preferred embodiment form alleviating to a substantial degree the entire historically occurring "first hammer out syndrome" problem.

In consideration of the preceding teaching, it will be understood that the present invention should be interpreted in consideration of the language of the following claims, only, and not solely in consideration of the preferred embodiment within which the present invention has been taught.

We claim:

1. In an impact printer in which plural hammers sequentially strike a paper form to print each line, the improvement comprising:

means for imparting to the first print hammer to strike said paper form in the printing of each line a higher energy than that imparted to other hammers used in printing that line, said higher energy being available for a predetermined time period to subsequently actuated print hammers in successively decreasing amounts according to proximity in time of the firing of the subsequent print hammers to the firing of the first print hammer, said higher energy being in compensation for the loss of impact energy due to movement of the paper by said hammers.

2. An apparatus for increasing the current drive to a print hammer first striking a workpiece form in each line printed by an impact printer, said apparatus comprising:

current drive means, controllable in the level of current drive, for supplying current drive to a multiplicity of print hammers; and boost means for controlling said current drive means to supply increased current drive to that print hammer first striking a workpiece form in each line printed by an impact printer, said boost means making the increased current drive available for a predetermined time period to subsequently actuated print hammers for successively decreasing time periods.

3. The apparatus according to claim 2 wherein said boost means further comprises:

boost means responsive to the normal, unincreased level of current drive for controlling said current drive means to supply increased current drive for a relatively shorter time when said normal level of current drive is relatively lower, and for a relatively longer time when said normal level of current drive is relatively higher.

4. The apparatus according to claim 2 wherein said boost means further comprises:

boost means for controlling said current drive means to supply increased current drive for a predetermined fractional portion of the flight time of that print hammer first striking said workpiece form.

5. The apparatus according to claim 4 wherein said predetermined fractional portion of the flight time is within the range of 25% to 50% of the total print hammer flight time.

6. A method for obtaining uniform print density across a line printed by an impact printer, said method comprising:

sensing a first actuation of at least one of a multiplicity of print hammers the printing of each line; and responsively to said sensing the first actuation, boosting the drive of said at least one first actuated print hammer in order that it strikes a workpiece form being printed harder than later actuated print hammers; and boosting the drive of successively actuated print hammers in successively smaller boost amounts until, at some stage of successive actuations of groups of print hammers, no boost is provided to the drive of said print hammers.

7. The method according to claim 6 wherein said boosting further comprises:

boosting said drive approximately 10%.

8. The method according to claim 6 wherein said boosting further comprises:

boosting said drive for a time duration within the range of 25% to 50% of the total time of the drive of each said one or more first actuated print hammers.

* * * * *